United States Patent [19]

Hoke

[11] 4,090,971

[45] May 23, 1978

[54] SUBSTITUTED SALICYLAMIDES AND LUBRICANTS CONTAINING THE SAME

[75] Inventor: Donald Irvin Hoke, Chagrin Falls, Ohio

[73] Assignee: The Lubrizol Corporation, Wickliffe, Ohio

[21] Appl. No.: 587,512

[22] Filed: Jun. 16, 1975

[51] Int. Cl.[2] ..... C10M 1/32

[52] U.S. Cl. ..... 252/51.5 A; 260/559 R

[58] Field of Search ..... 252/51.5 A; 260/559 R

[56] References Cited

U.S. PATENT DOCUMENTS

| | | | |
|---|---|---|---|
| 2,848,418 | 8/1958 | Müller et al. | 252/51.5 A |
| 2,959,550 | 11/1960 | Young et al. | 260/559 R |
| 3,034,879 | 5/1962 | Spacht | 252/51.5 A |
| 3,368,972 | 2/1968 | Otto | 252/51.5 R |
| 3,803,039 | 4/1974 | Piasek et al. | 252/51.5 A |

*Primary Examiner*—Daniel E. Wyman
*Assistant Examiner*—Y. Harris-Smith
*Attorney, Agent, or Firm*—James W. Adams, Jr.; S. I. Khayat

[57] ABSTRACT

Amides of alkyl-substituted hydroxyaromatic carboxylic acids (especially alkyl-substituted salicylic acids) and the like, in which the alkyl substituent contains at least about 10 carbon atoms, are useful as dispersant additives for lubricants and fuels. Particularly useful are salicylamides in which the substituent is derived from propylene, 1-butene or isobutene and has a molecular weight of about 150–1750, and in which the amide moiety is derived from an alkylene polyamine. Such amides are preferably prepared by the reaction of the corresponding nitrogen-containing compound with a vic-hydroxyalkyl ester of the salicylic acid.

19 Claims, No Drawings

SUBSTITUTED SALICYLAMIDES AND LUBRICANTS CONTAINING THE SAME

This invention relates to new compositions of matter useful as dispersant additives for lubricants and normally liquid fuels, and to lubricants and concentrates containing the same. More particularly, it relates to compositions comprising amides of substituted hydroxy-aromatic carboxylic acids in which at least one substituent is a hydrocarbon-based radical containing at least about 10 carbon atoms.

As used herein, the term "hydrocarbon-based radical" denotes a radical having a carbon atom directly attached to the remainder of the molecule and having predominantly hydrocarbon character within the context of this invention. Such radicals include the following:

(1) Hydrocarbon radicals; that is, aliphatic, (e.g., alkyl or alkenyl), alicyclic (e.g., cycloalkyl or cycloalkenyl), aromatic, aliphatic- and alicyclic- substituted aromatic, aromatic-substituted aliphatic and alicyclic radicals, and the like, as well as cyclic radicals wherein the ring is completed through another portion of the molecule (that is, any two substituents may together form an alicyclic radical). Such radicals are known to those skilled in the art. Examples of those having at least about 10 carbon atoms, and thus contemplated as within the scope of this invention, include decyl, isodecyl, dodecyl, pentadecyl, eicosyl, triacontyl and the like, as well as radicals derived from substantially saturated petroleum fractions, olefin polymers and highly refined white oils or synthetic alkanes.

(2) Substituted hydrocarbon radicals; that is, radicals containing non-hydrocarbon substituents which, in the context of this invention, do not alter the predominantly hydrocarbon character of the radical. Those skilled in the art will be aware of suitable substituents; examples are halo, nitro, cyano, $$RO-,\ ROC(=O)-,\ RNHC(=O)-,\ R'C(=O)-,\ R'S(=O)_2-\text{ and }R'S(=O)_2-,$$

wherein R may be hydrogen or a hydrocarbon radical and R' may be a hydrocarbon radical.

(3) Hetero radicals; that is, radicals which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen, and sulfur.

In general, no more than about three substituents or hetero atoms, and preferably no more than one, will be present for each 10 carbon atoms in the hydrocarbon-based radical.

As previously noted, the amides of this invention are derived from substituted hydroxyaromatic carboxylic acids in which one substituent is a hydrocarbon-based radical as defined hereinabove. The radical is preferably an aliphatic-hydrocarbon radical free from acetylenic unsaturation. It is usually substantially saturated; i.e., at least about 95% of the carbon-to-carbon bonds are saturated. The radical usually contains about 10–7000 carbon atoms, preferably about 10–225 carbon atoms. In some instances, however, a higher molecular weight radical, e.g., one having a molecular weight of about 50,000–100,000 (number average, as determined by vapor phase osmometry), is desirable since such a radical can impart viscosity index improving properties to the composition.

Especially desirable for the purposes of this invention are amides of acids containing aliphatic substituents derived from polymers of propylene, 1-butene or isobutene, said substituents having a molecular weight of about 150–3000 and usually of at least about 500.

Hydroxyaromatic precursors for the carboxylic acids convertible to amides of this invention include phenol, naphthols, phenols and naphthols containing lower molecular weight alkyl substituents as well as other substituents of the type recited hereinabove with reference to the hydrocarbon-based radical, etc. Phenol is the preferred hydroxyaromatic precursor. The hydroxyaromatic compound containing the hydrocarbon-based radical is conveniently prepared by reacting a hydrocarbon-based compound, preferably a polymer as aforementioned, with the hydroxyaromatic precursor at a temperature of about 50°–200° C. in the presence of a suitable catalyst such as aluminum chloride, boron trifluoride or zinc chloride.

The substituted hydroxyaromatic carboxylic acid may contain more than one hydrocarbon-based substituent as defined hereinabove. It may also contain lower molecular weight alkyl substituents as well as other substituents of the type recited hereinabove with reference to the hydrocarbon-based radical. Acids containing more than one hydroxy or carboxy radical are contemplated as within the scope of the invention. Usually, however, the substituted hydroxyaromatic carboxylic acid will contain only one hydrocarbon-based substituent, one hydroxy radical and one carboxy radical. Especially preferred are the hydrocarbon-substituted salicyclic acids. Reference hereinafter will be made primarily to the salicylic acids, but it is to be understood that other substituted hydroxyaromatic carboxylic acids may be used in place thereof.

Substituted salicylic acids may be prepared from the corresponding substituted phenols, which are well known in the art, by the "Kolbe-Schmitt reaction" which comprises reacting a salt, preferably an alkali metal salt, of the phenol with carbon dioxide and subsequently acidifying the salt thus obtained. The conditions of the carbonation reaction are likewise well known to those skilled in the art. It may be carried out at atmospheric or superatmospheric pressure in a substantially inert, non-polar liquid diluent as defined hereinafter.

The amides of this invention may be prepared from the free salicylic acids or derivatives thereof by known methods. Thus, they may be prepared by reaction of at least one suitable nitrogen compound with at least one free acid or with at least one acid halide, ester, anhydride or the like. Related acyl nitrogen compounds, such as imides and amidines, are included within the term "amide" for the purposes of this invention. Suitable nitrogen compounds are those characterized by a radical of the structure >NH wherein the two remaining valences of nitrogen are satisfied by hydrogen, amino or organic radicals bonded to said nitrogen atom through direct carbon-to-nitrogen linkages. These compounds include aliphatic, aromatic, heterocyclic and carbocyclic amines as well as substituted ureas, thioureas, hydrazines, guanidines, amidines, amides, thioamides, cyanamides and the like.

Among the amines useful in preparing the amides of this invention are monoamines. These monoamines can be secondary, i.e., those containing only one hydrogen atom bonded directly to an amino nitrogen atom. Preferably, however, they contain at least one primary amino group, i.e., a group wherein an amino nitrogen atom is directly bonded to two hydrogen atoms. The monoamines are generally substituted with $C_{1-30}$ hydrocarbon-based radicals. Preferably these hydrocarbon-based radicals are aliphatic in nature and contain 1–10 carbon atoms. Saturated aliphatic hydrocarbon radicals containing 1–10 carbon atoms are particularly preferred.

Among the preferred monoamines useful in making the amides of this invention are those of the general formula $HNR^1R^2$ wherein $R^1$ is an alkyl radical of up to ten carbon atoms and $R^2$ is hydrogen or an alkyl radical of up to ten carbon atoms. Another preferred class of monoamines are aromatic monoamines of the general formula $HNR^3R^4$ wherein $R^3$ is a phenyl, alkylated phenyl, naphthyl or alkylated naphthyl radical of up to ten carbon atoms and $R^4$ is a hydrogen atom, an alkyl radical of up to 10 carbon atoms or $R^2$. Representative examples of these two classes of monoamines are ethylamine, diethylamine, n-butylamine, di-n-butylamine, allylamine, isobutylamine, cocoamine, stearylamine, laurylamine, methyllaurylamine, oleylamine, aniline, methylaniline, N-methylaniline, diphenylamine, benzylamine, tolylamine, methyl-2-cyclohexylamine, etc.

Hydroxy amines are also included in the class of useful monoamines. Such compounds are the hydroxyhydrocarbyl-substituted analogs of the afore-described monoamines. Preferred hydroxy monoamines have the following general formulae:

$$HNR^5R^6$$

and $$HNR^7R^8$$

wherein $R^5$ is an alkyl or hydroxy-substituted alkyl radical of up to 10 carbon atoms, $R^6$ is a hydrogen atom or $R^5$, $R^7$ is a hydroxy-substituted phenyl, alkylated phenyl, naphthyl or alkylated naphthyl radical of up to 10 carbon atoms and $R^8$ is a hydrogen atom or $R^7$, at least one of $R^5$ and $R^6$ and at least one of $R^7$ and $R^8$ being hydroxy-substituted.

Suitable hydroxy-substituted monoamines include ethanolamine, di-3-propanolamine, 4-hydroxybutylamine, diethanolamine, n-methyl-2-propylamine, 3-hydroxyaniline, N-hydroxyethylethylene diamine, N,N-di(hydroxypropyl)propylene diamine, tris(hydroxymethyl)methylamine, etc. While in general, hydroxy amines containing only one hydroxy group will be employed as reactants, those containing more can also be used.

Heterocyclic amines are also useful in making the amides of this invention, providing they contain a primary or secondary amino group. The ring can also incorporate unsaturation and can be substituted with hydrocarbon radicals such as alkyl, alkenyl, aryl, alkaryl or aralkyl. In addition, the ring can also contain other hetero atoms such as oxygen, sulfur or other nitrogen atoms, including those not having hydrogen atoms bonded to them. Generally, these rings have 3–10, preferably 5 or 6, ring members. Among such heterocycles are aziridines, azetidines, azolidines, pyridines, pyrroles, piperidines, imidazoles, indoles, piperazines, isoindoles, purines, morpholines, thiamorpholines, N-aminoalkyl morpholines, N-aminoalkyl thiamorpholines, azepines, azocines, azonines, azecines, and tetra-, di- and perhydro-derivatives of each of the above. Preferred heterocyclic amines are the saturated ones with 5- and 6- membered rings, especially the piperidines, piperazines and morpholines described above.

Polyamines are preferred for preparing the amides of this invention. Among the polyamines are alkylene polyamines including those having the formula

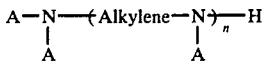

wherein n is an average of integers between about 1 and 10, preferably between 2 and 8; each A is independently a hydrogen atom or a hydrocarbon or hydroxy-substituted hydrocarbon radical having up to about 30 atoms, and "Alkylene" is a divalent hydrocarbon radical having about 1–18 carbons. Preferably A is an aliphatic radical of up to about 10 carbon atoms which may be substituted with one or two hydroxy groups, and "Alkylene" is a lower alkylene radical having 1–10, preferably 2–6, carbon atoms. Especially preferred are the alkylene polyamines wherein each A is hydrogen. Such alkylene polyamines include methylene polyamines, ethylene polyamines, butylene polyamines, propylene polyamines, pentylene polyamines, hexylene polyamines, heptylene polyamines, etc. The higher homologs of such amines and related aminoalkyl-substituted piperazines are also included. Specific examples of such polyamines include ethylene diamine, triethylene tetramine, tris(2-aminoethyl)-amine, propylene diamine, trimethylene diamine, hexamethylene diamine, decamethylene diamine, octamethylene diamine, di(heptamethylene)triamine, tripropylene tetramine, tetraethylene pentamine, trimethylene diamine, pentaethylene hexamine, di(trimethylene)triamine, 2-heptyl-3-(2-aminopropyl)imidazoline, 1,3-bis(2-aminoethyl)imidazolidine, 1-(2-aminopropyl)-piperazine, 1,4-bis(2-aminoethyl)piperazine and 2-methyl-1-(2-aminobutyl)-piperazine. Higher homologs, obtained by condensing two or more of the above-illustrated alkylene amines, are also useful.

The ethylene polyamines, examples of which are mentioned above, are especially useful for reasons of cost and effectiveness. Such polyamines are described in detail under the heading "Diamines and Higher Amines" in Kirk-Othmer, *Encyclopedia of Chemical Technology,* Second Edition, Vol. 7, pp. 22–39. They are prepared most conveniently by the reaction of an alkylene chloride with ammonia or by reaction of an ethylene imine with a ring-opening reagent such as ammonia. These reactions result in the production of the somewhat complex mixtures of alkylene polyamines, including cyclic condensation products such as piperazines. These mixtures are particularly useful in preparing the compositions of this invention. Satisfactory products can also be obtained by the use of pure alkylene polyamines.

Hydroxy polyamines, e.g., alkylene polyamines having one or more hydroxyalkyl substituents on the nitrogen atoms, are also useful in preparing amides of this invention. Preferred hydroxyalkyl-substituted alkylene polyamines are those in which the hydroxyalkyl group has less than about 10 carbon atoms. Examples of such hydroxyalkyl-substituted polyamines include N-(2-hydroxyethyl)-ethylene diamine, N,N'-bis(2-hydroxyethyl)ethylene diamine, 1-(2-hydroxyethyl)-piperazine, monohydroxypropyl-substituted diethylene triamine, dihydroxypropyltetraethylene pentamine and N-(3-hydroxybutyl)tetramethylene diamine. Higher homologs obtained by condensation of the above-illustrated hydroxyalkyl-substituted alkylene amines through amino radicals or through hydroxy radicals are likewise useful.

The amides of this invention can also be prepared from hydrazine or an organo-substituted hydrazine of the general formula

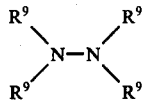

wherein each $R^9$ is independently hydrogen or a $C_{1-30}$ hydrocarbon radical, at least one $R^9$ radical being hydrogen. Preferably, the other $R^9$ radicals are $C_{1-10}$ aliphatic groups. More preferably at least two $R^9$ groups are hydrogen and most preferably at least two $R^9$ groups bonded to the same nitrogen atom are hydrogen and the remaining $R^9$ groups are alkyl groups of up to 10 carbon atoms. Examples of suitable substituted hydrazines are methylhydrazine, N,N-dimethylhydrazine, N,N'-dimethylhydrazine, phenylhydrazine, N-phenyl-N'-ethylhydrazine, N-(p-tolyl)-N'-(n-butyl)hydrazine, N-(p-nitrophenyl)-N-methylhydrazine, N,N'-di-(p-chlorophenyl)hydrazine and N-phenyl-N'-cyclohexylhydrazine.

A preferred method for producing the amides of this invention is by the reaction of a nitrogen compound as described hereinabove with a vic-hydroxyalkyl ester of the salicyclic acid. Such vic-hydroxyalkyl esters are conveniently prepared by the reaction of the free salicyclic acid with an epoxide. Suitable epoxides include ethylene oxide, propylene oxide, the butylene oxides, styrene oxide, glycidyl esters and ethers, butyl epoxystearate and the like. Lower aliphatic epoxides (the word "lower" denoting compounds having up to seven carbon atoms) are preferred, especially ethylene oxide and propylene oxide.

The reaction of the free salicyclic acid with the epoxide is usually effected at a temperature above about 50° C. and lower than the decomposition temperature of the reaction mass and the constituents thereof. The temperature is ordinarily about 50°–225° C., preferably about 90°–180° C. The ratio of equivalents of epoxide to salicylic acid is usually between about 1:1 and 5:1.

The reaction is typically carried out in the presence of a substantially inert, non-polar, normally liquid organic diluent. Suitable diluents will be apparent to those skilled in the art and include, for example, hydrocarbons such as naphtha, mineral oil, benzene, toluene and xylene. Ordinarily, a basic catalyst such as an alkali metal hydroxide or carbonate is also present in relatively small amounts.

The reaction between the nitrogen compound and the vic-hydroxyalkyl ester is usually carried out between room temperature and the decomposition temperature of the reaction mixture, most often at about 100°–200° C.

The relative proportions of organic nitrogen compound to vic-hydroxyalkyl ester are not critical. Generally, the ratio of equivalents of nitrogen compound to ester will be at least about 1:1. (For the purposes of this invention, equivalent weights of the nitrogen compound and the vio-hydroxyalkyl ester are determined by dividing their molecular weights by the number of —NH groups and ester groups, respectively, per molecule.) From a stoichiometric standpoint, not more than one equivalent of nitrogen compound is required per mole of ester. However, it is frequently preferred to use a stoichiometric excess of nitrogen compound, typically up to about 10 and usually 3 or less equivalents per equivalent of ester.

It is possible, though frequently not necessary, to employ a substantially inert, normally liquid organic diluent, typically a hydrocarbon (such as those enumerated above with respect to ester preparation), an alcohol such as ethanol, propanol or the like, an ether alcohol such as ethylene glycol monomethyl ester, or a similar diluent of the type known to those skilled in the art.

Purification of the amides of this invention is usually not necessary, since they may be dissolved in a suitable diluent such as mineral oil and used directly as lubricant additives. If purification is desired, it may be accomplished by conventional methods such as distillation.

Also within the scope of this invention are chemical post-treatment products of the above-described amides. For the purpose of this invention, "post-treatment products" include those obtained by post-treating the salicylic acids and subsequently converting them to amides, and those obtained by post-treating the amides themselves. Among the post-treatment products contemplated within the scope of this invention are the following:

(1) Sulfur-containing products obtained by reaction with sulfur, sulfur halides such as sulfur monochloride and sulfur dichloride, or carbon disulfide.

(2) Alkylene-bridged compounds formed by reaction with an aldehyde (usually formaldehyde) or a reversible polymer thereof such as paraformaldehyde.

(3) Mannich bases formed by reaction with an aldehyde (usually formaldehyde) or a reversible polymer thereof and an amine containing at least one hydrogen atom bonded directly to nitrogen.

(4) Acylated products obtained by reaction with an aliphatic carboxylic acid, especially a hydrocarbon-substituted succinic acid, or derivative thereof such as an anhydride, acyl halide, ester or the like.

(5) Sequential post-treatment products involving combinations of the foregoing. For example, a methylenebridged composition may subsequently be sulfurized, acylated with a hydrocarbon-substituted succinic acid, converted into a Mannich base or the like.

The preparation of the amides of this invention is illustrated by the following examples. All percentages and parts are by weight. Molecular weights and equivalent weights are number average figures as determined by vapor phase osmometry, acid number or hydroxyl analysis.

EXAMPLE 1

A mixture of 1830 parts (5 equivalents) of an alkyl-substituted salicylic acid formed by alkylating phenol with tetrapropene and subjecting the resulting alkyl phenol to the Kolbe reaction, 207 parts (5 equivalents) of a commercial ethylene polyamine mixture containing about 3–7 nitrogen atoms per molecule, and 500 parts of mineral oil is heated to 170° C. for 3 hours as water is removed by distillation. It is then heated to 210° C. for 2 hours with the removal of additional water, and is filtered with the addition of a filter aid material. The filtrate is the desired amide (80% solution in mineral oil) and contains 2.94% nitrogen.

EXAMPLE 2

A mixture of 3400 parts of an alkyl phenol (Mn 262) similar to that of Example 1, 500 parts of xylene, 1000 parts of mineral oil and 944 parts of potassium hydroxide is heated under reflux for 6 hours and then stripped to 255° C. under nitrogen. Carbon dioxide blowing is started at 207° C. and the reaction mixture is allowed to cool to 145° C. Carbon dioxide blowing is continued at 145°-150° C. until the reaction is complete. The mixture is then cooled to 90° C. Toluene, 1000 parts, is added, followed by 1440 parts of concentrated hydrochloric acid over 4.5 hours. The mixture is then heated under reflux at 100°-103° C. for 4.5 hours as water is removed by azeotropic distillation. The product is filtered, stripped to 141° C. under vacuum and filtered again to yield 4809 parts of a substituted salicylic acid.

A mixture of 1414 parts of the substituted salicylic acid and one part of lithium hydroxide hydrate is heated to 103°-105° C. Ethylene oxide, 200 parts, is added over 4.5 hours. The mixture is stripped at 106° C. under vacuum and filtered, yielding a 2-hydroxyethyl ester (73% solution in mineral oil).

A mixture of 550 parts (1.0 equivalent) of the 2-hydroxyethyl ester and 105 parts (1.0 equivalent) of diethanolamine is heated at 195°-200° C. for twelve hours as ethylene glycol is removed by blowing with nitrogen. The mixture is stripped to 116° C. under vacuum and filtered to yield the desired amide (75% solution in mineral oil, containing 2.48% nitrogen).

EXAMPLE 3

A mixture of 319 parts of an ester prepared as described in Example 2 and 15 parts of ethylene diamine is heated at 110°-118° C. for 4.5 hours, stripped at 170° C. under vacuum and filtered. The filtrate is the desired amide (73% solution in mineral oil, containing 2.24% nitrogen).

EXAMPLE 4

A mixture of 319 parts of an ester prepared as described in Example 2 and 65 parts of di-n-butylamine is heated at 110°-200° C. for 13½ hours. The mixture is then stripped at 190°-200° C. under vacuum and filtered. The filtrate is the desired amide (77% solution in mineral oil, containing 1.11% nitrogen).

EXAMPLE 5

A mixture of 402 parts of the ester of Example 2, 46 parts of mineral oil and 30 parts of the ethylene polyamine mixture of Example 1 is heated to 120°-195° C. over 4½ hours and then stripped under vacuum to remove the ethylene glycol. The desired amide is obtained upon filtration as a 65% solution in mineral oil, containing 2.29% nitrogen.

EXAMPLE 6

A mixture of 5720 parts (5.5 equivalents) of an alkyl phenol (Mn 885) prepared by alkylation of phenol with polyisobutene, and 399 parts (6.05 equivalents) of commercially available, hydrated potassium hydroxide is heated at 250°-260° C. for 12 hours and dried under nitrogen. At 210° C., 2000 parts of mineral oil is added. Carbon dioxide blowing is started at 180° C. and the reaction mixture is allowed to cool to 145° C. Carbon dioxide blowing is continued at 145°-155° C. until the reaction is complete. The reaction mixture is cooled to 85° C. and 589 parts of concentrated hydrochloric acid is added. Then 800 parts of toluene and 500 parts of water are added and the mixture is heated under reflux for 2 hours, stripped and filtered to yield a substituted salicylic acid.

A mixture of 5619 parts (2.95 equivalents) of the substituted salicylic acid and 15 parts of lithium carbonate is heated to 110°-120° C. and ethylene oxide is bubbled through until a weight increase of 130 parts is obtained. The mixture is held at 120°-140° C. for 3.5 hours, then stripped at 125°-130° C. under vacuum to yield a 2-hydroxyethyl ester (68% solution in mineral oil).

A mixture of 1487 parts of the 2-hydroxyethyl ester and 32 parts of the ethylene polyamine mixture of Example 1 is heated at 130°-140° C. for two hours, stripped at 190° C. under vacuum and filtered to yield the desired amide (68% solution in mineral oil, containing 0.91% nitrogen).

EXAMPLE 7

A mixture of 1487 parts of the 2-hydroxyethyl ester of Example 6 and 85 parts of tris(hydroxymethyl-)amino- methane is heated to 165°-170° C. over 2.75 hours, stripped to 205° C. under vacuum, and the mixture is filtered to yield the desired amide (69% solution in mineral oil, containing 0.38% nitrogen).

EXAMPLE 8

A mixture of 975 parts of a substituted salicylic acid (prepared as in Example 6 except that the polyisobutene has an Mn of 300) and 0.5 part of lithium hydroxide hydrate is heated to 106° C. and 45 parts of ethylene oxide is added over three hours. The mixture is maintained at 104°-105° C. for 4.5 hours, stripped under vacuum and filtered to yield 972 parts of the 2-hydroxyethyl ester (68% solution in mineral oil).

A mixture of 804 parts of the 2-hydroxyethyl ester and 34 parts of the ethylene polyamine mixture of Example 1 is heated under vacuum to 110°-178° C. over 7 hours. The resulting mixture is filtered, yielding the desired amide as a 67% solution in mineral oil, containing 1.46% nitrogen.

EXAMPLE 9

A mixture of 136 parts of ethylene oxide and 948 parts of a 67% solution in mineral oil of the substituted salicylic acid of Example 8 is heated at 70°-80° C. over ten hours, stripped at 70°-80° C. under vacuum and filtered to yield a substituted salicylic acid ester.

Hydroxylamine hydrochloride, 69.5 parts, and 1500 parts of ethanol are added to a solution of 992 parts of the ester in 450 parts of ethanol at room temperature. The mixture is stirred at room temperature for 24 hours. A solution of 46 parts of sodium metal and 960 parts of ethanol is added dropwise to the mixture over two hours. The reaction mixture is stripped to 155° C. under vacuum and cooled, and 500 parts of toluene is added. Then 133 parts of aqueous hydrochloric acid is added over two hours. Water is removed by azeotropic distillation and the mixture is filtered, stripped at 50°-60° C. under vacuum, and filtered again. The filtrate is the product (67% solution in mineral oil, containing 0.74% nitrogen).

EXAMPLE 10

A mixture of 7566 parts (7.3 equivalents) of an alkyl phenol (Mn 885) prepared by alkylation of phenol with polyisobutene, 2000 parts of mineral oil and 546 parts (8.77 equivalents) of potassium hydroxide is heated at 120°-255° C. under nitrogen for about 32.5 hours and cooled to 150° C. Carbon dioxide is bubbled through the reaction mixture until reaction is complete. The mixture is filtered, yielding an oil solution of a substituted salicylic acid.

Sulfur monochloride, 329 parts, is added to 6788 parts of the above-described substituted salicylic acid at 124° C. over 2.5 hours. The mixture is held at 120°-130° C. for one hour and then 712 parts of toluene is added. At 80° C., 712 parts of water and 48.9 parts of concentrated hydrochloric acid are added. The water is removed by azeotropic distillation, the mixture is stripped at 138° C. under vacuum and 2267 parts of mineral oil is added. Upon filtration, a sulfurized intermediate is obtained.

Ethylene oxide, 448 parts, is bubbled through 8286 parts of the sulfurized intermediate at 100° C. over 15 hours. The mixture is stripped at 100° C. under vacuum to yield a sulfurized ester intermediate.

To 8346 parts thereof is added 280 parts of the ethylene polyamine mixture of Example 1. The resulting mixture is heated at 190° C. under vacuum for 3 hours as ethylene glycol is removed continuously. Mineral oil, 79 parts, is added to the residue and the oil solution is filtered at 160°-180° C. to yield the desired amide (60% solution in mineral oil, containing 1.07% nitrogen).

EXAMPLE 11

A mixture of 5950 parts (5.0 equivalents) of an alkyl phenol (Mn 900) prepared by alkylation of phenol with polyisobutene and 363 parts (5.5 equivalents) of potassium hydroxide is heated at 250°-255° C. for 12 hours and dried under nitrogen. At 230° C., 3000 parts of mineral oil is added. Carbon dioxide blowing is started at 160° C. and the reaction mixture is allowed to cool to 150° C. Carbon dioxide blowing is continued at 150°-155° C. until the reaction is complete. The residue is the desired substituted salicylic acid salt.

A mixture is prepared by the addition of 281 parts of sulfur dichloride to 9159 parts of the salicylic acid salt at 100°-130° C. over 2.5 hours. This mixture is held at 125°-130° C. for 3.5 hours and then cooled to 60° C. and 200 parts of water, 400 parts of toluene and 50 parts of concentrated hydrochloric acid are added. The water is removed by azeotropic distillation and the mixture is stripped at 125°-130° C. under vacuum to yield a sulfurized acid intermediate.

A mixture of 8439 parts of the sulfurized acid intermediate and 4 parts of lithium hydroxide hydrate is heated to 110° C. and ethylene oxide is bubbled through the mixture until a weight increase of 143 parts is obtained. The mixture is held at 120° C. for 1 hour, then stripped to 120° C. under vacuum to yield the desired ester.

A mixture of 7487 parts of the ester and 175 parts of the ethylene polyamine mixture of Example 1 is heated at 90°-100° C. for 3 hours, stripped at 185° C. under vacuum for 4.5 hours and filtered. The filtrate is the desired amide (67% solution in mineral oil, containing 0.76% sulfur and 0.73% nitrogen).

EXAMPLE 12

A mixture of 744 parts of an amide prepared as described in Example 6, 20 parts of the ethylene polyamine mixture of Example 1, 11 parts of paraformaldehyde and 200 parts of toluene is heated at 130°-134° C. as water is removed by azeotropic distillation. The mixture is cooled to room temperature and 145 parts of mineral oil is added. The mixture is then stripped to 151° C. under vacuum and filtered at 140° C. to yield the desired amido Mannich base (84% solution in mineral oil).

EXAMPLE 13

A mixture of 6446 parts of the 2-hydroxyethyl ester of Example 6 and 266 parts of the ethylene polyamine mixture of Example 1 is heated to 190° C. under vacuum over 7.5 hours, while ethylene glycol is continuously removed. The mixture is cooled to room temperature and 500 parts of toluene is added. At 96° C., 80 parts of paraformaldehyde is added and the mixture is dried by azeotropic distillation. Mineral oil, 1243 parts, is added and the mixture is stripped to 135° C. under vacuum and filtered to yield the desired amide (60% solution in mineral oil, containing 1.13% nitrogen).

EXAMPLE 14

A mixture of 1615 parts of the amide of Example 13 and 32 parts of sulfur is heated at 155°-160° C. for 8.5 hours under nitrogen. At 93° C., 48 parts of carbon disulfide is added slowly under the surface over 1.5 hours with nitrogen blowing. The mixture is heated at 142°-166° C. for 10 hours and stripped to 176° C. under vacuum. At 120° C. 30 parts of mineral oil is added and the mixture is filtered to yield the desired product (60% solution in mineral oil, containing 1.11% nitrogen and 0.91% sulfur).

As previously indicated, the amides of this invention are useful as additives for lubricants and normally liquid fuels, where they function primarily as dispersants; that is, they maintain accumulated sludge, dirt and other insolubles in suspension. The lubricants in which these compositions can be employed include diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, jet aircraft turbines, stationary power engines and turbines and the like. Automatic transmission fluids, transaxle lubricants, gear lubricants, metal-working lubricants, hydraulic fluids and other lubricating oil and grease compositions can also benefit from the incorporation therein of the amides of the present invention.

Natural oils include animal oils and vegetable oils (e.g., castor oil, lard oil) as well as liquid petroleum oils and solvent-treated or acid-treated mineral lubricating oils of the paraffinic, naphthenic or mixed paraffinic-naphthenic types. Oils of lubricating viscosity derived from coal or shale are also useful base oils. Synthetic lubricating oils include hydrocarbon oils and halosubstituted hydrocarbon oils such as polymerized and interpolymerized olefins [e.g., polybutylenes, polypropylenes, propylene-isobutylene copolymers, chlorinated polybutylenes, poly(1-hexenes), poly(1-octenes), poly(1-decenes), etc. and mixtures thereof]; alkylbenzenes (e.g. dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.), alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic lubricating oils. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters, mixed $C_3$–$C_8$ fatty acid esters, or the $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants [e.g., tetraethyl silicate, tetraisopropyl silicate, tetra-(2-ethylhexyl) silicate, tetra-(4-methyl-2-ethylhexyl) silicate, tetra-(p-tert-butylphenyl) silicate, hexyl-(4-methyl-2-pentoxy) disiloxane, poly(methyl) siloxanes, poly(methylphenyl) siloxanes, etc.]. Other synthetic lubricating oils include liquid esters of phosphorus-containing acids (e.g., tricresyl phosphate, trioctyl phosphate, diethyl ester of decylphosphonic acid, etc.), polymeric tetrahydrofurans and the like.

Unrefined, refined and rerefined oils (and mixtures of each with each other) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, acid or base extraction, filtration, percolation, etc. Rerefined oils are obtained by process similar to those used to obtain refined oils applied to refined oils which have been already used in service. Such rerefined oils are also known as reclaimed or reprocessed oils and often are additionally processed by techniques directed to removal of spent additives and oil breakdown products.

Generally, the lubricants of the present invention contain a minor amount of the amide sufficient to disperse sludge and other insolubles therein. Normally this amount will be about 0.05–20.0%, preferably about 0.5–10.0%, of the total weight of the lubricant. In lubricating oils operated under extremely adverse conditions, such as lubricating oils for marine diesel engines, the amides of this invention may be present in amounts of up to about 30%.

The invention also contemplates the use of other additives in combination with the amides of this invention. Such additives include, for example, auxiliary detergents and dispersants of the ash-producing or ashless type, corrosion- and oxidation-inhibiting agents, pour point depressing agents, extreme pressure agents, color stabilizers and anti-foam agents.

The ash-producing detergents are exemplified by oil-soluble neutral and basic salts of alkali or alkaline earth metals with sulfonic acids, carboxylic acids, or organic phosphorous acids characterized by at least one direct carbon-to-phosphorous linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature above 50° C. and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl$\beta$-naphthylamine, and dodecylamine. A particularly effective method for preparing the basic salts comprises mixing an acid with an excess of basic alkaline earth metal neutralizing agent and at least one alcohol promoter, and carbonating the mixture at an elevated temperature such as 60°–200° C.

Auxiliary ashless detergents and dispersants are so called despite the fact that, depending on its constitution, the dispersant may upon combustion yield a nonvolatile material such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

(1) Reaction products of carboxylic acids (or derivatives thereof) containing at least about 34 and preferably at least about 54 carbon atoms with nitrogencontaining compounds such as amine, organic hydroxy compounds such as phenols and alcohols, and/or basic inorganic materials. Examples of these "carboxylic dispersants" are described in British Pat. No. 1,306,529 and in many U.s. patents including the following U.S. Pat. Nos:

| | | |
|---|---|---|
| 3,163,603 | 3,272,746 | 3,340,281 |
| 3,184,474 | 3,281,357 | 3,341,542 |
| 3,215,707 | 3,306,908 | 3,346,493 |
| 3,219,666 | 3,311,558 | 3,351,552 |
| 3,271,310 | 3,316,177 | 3,381,022 |
| 3,399,141 | 3,467,668 | 3,576,743 |
| 3,415,750 | 3,501,405 | 3,630,904 |
| 3,433,744 | 3,522,179 | 3,632,510 |
| 3,444,170 | 3,541,012 | 3,632,511 |
| 3,448,048 | 3,542,678 | 3,697,428 |
| 3,448,049 | 3,542,680 | 3,725,441 |
| 3,451,933 | 3,567,637 | Re26,433 |
| 3,454,607 | 3,574,101 | |

(2) Reaction products of relatively high molecular weight aliphatic or alicyclic halides with amines, preferably polyalkylene polyamines. These may be characterized as "amine dispersants" and examples thereof are described for example, in the following U.S. patents Nos.

| | |
|---|---|
| 3,275,554 | 3,454,555 |
| 3,438,757 | 3,565,804 |

(3) Reaction products of alkyl phenols in which the alkyl group contains at least about 30 carbon atoms with aldehydes (especially formaldehyde) and amines (especially polyalkylene polyamides), which may be characterized as "Mannich dispersants". The materials described in the following U.S. patents are illustrative.

| | |
|---|---|
| 3,413,347 | 3,725,480 |
| 3,697,574 | 3,726,882 |
| 3,725,277 | |

(4) Products obtained by post-treating the carboxylic, amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos.

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |

(5) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. Pat. Nos.

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

Extreme pressure agents and corrosion- and oxidation-inhibiting agents are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; phosphorus esters including principally dihydrocarbon and trihydrocarbon phosphites such as dibutyl phosphite, diheptyl phosphite, dicyclohexyl phosphite, pentyl phenyl phosphite, dipentyl phenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium hepthylphenyl dithiocarbamate; Group II metal phosphorodithioates such as zinc dicyclohexylphosphorodithioate, zinc dioctylphosphorodithioate, barium di(heptylphenyl)phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

The fuel compositions containing the amides of this invention contain a major proportion of a normally liquid fuel, usually a hydrocarbonaceous petroleum distillate fuel such as motor gasoline as defined by ASTM Specification D-439-73 and diesel fuel or fuel oil as defined by ASTM Specification D-396. Normally liquid fuel compositions comprising non-hydrocarbonaceous materials such as alcohols, ethers, organo-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Normally liquid fuels which are mixtures of one or more hydrocarbonaceous fuels and one or more non-hydrocarbonaceous materials also contemplated. Examples of such mixtures are gasoline-ethanol and diesel fuel-ether combinations. Particularly preferred is gasoline, that is, a mixture of hydrocarbons having an ASTM boiling point of about 60° C. at the 10% distillation point to about 205° C. at the 90% distillation point.

Generally, these fuel compositions contain an amount of the amide of this invention sufficient to disperse sludge and other insolubles therein and/or to clean fuel system components such as fuel lines and carburetors; usually this amount is about 1–50,000, preferably 4–5000, parts by weight per million parts of fuel.

The fuel compositions can contain, in addition to the amide of this invention, other additives which are well known to those of skill in the art. These can include antiknock agents such as tetra-alkyl lead compounds, lead scavengers such as halo-alkanes (e.g., ethylene dichloride and ethylene dibromide), deposit preventers or modifiers such as triaryl phosphates, dyes, cetane improvers, antioxidants such as 2,6-di-tertiary-butyl-4-methylphenol, rust inhibitors, such as alkylated succinic acids and anhydrides, bacteriostatic agents, gum inhibitors, metal deactivators, demulsifiers, upper cylinder lubricants, antiicing agents and the like.

The amides of this invention can be added directly to the lubricant or fuel. Preferably, however, they are diluted with a substantially inert organic liquid diluent such as mineral oil, naphtha, benzene, toluene, xylene or gasoline to form an additive concentrate. These concentrates generally contain about 20–90% of the amide of this invention and may contain, in addition, one or more of the other additives described hereinabove.

Typical lubricating compositions of this invention are listed in the following table. Except for the values for mineral oil and for the products of Examples 11 and 12, all amounts are exclusive of mineral oil used as diluent.

| Ingredient Lubricant | Parts by Weight A | Parts by Weight B |
|---|---|---|
| Mineral oil | 89.39 | 89.68 |
| Product of Example 11 | 4.30 | — |
| Product of Example 12 | — | 4.44 |
| Basic calcium petroleum sulfonate | 2.57 | — |
| Basic calcium salt of sulfurized alkylphenol | 1.69 | — |
| Borated polyisobutenyl (mol.wt.1000) succinimide | — | 2.00 |
| Tetrapropenyl succinic anhydride | — | 0.34 |
| Zinc tetrapropenylphenyl-phosphorodithioate | 2.05 | — |
| Sulfurized Diels-Alder adduct of butadiene and alkyl acrylate | — | 1.30 |
| Reaction product of alkylphenol, formaldehyde and 2,5-dimercapto-1,3,4-thiadiazole | — | 0.49 |
| Ethylene-propylene-diene terpolymer | — | 1.29 |
| Hindered phenol antioxidant | — | 0.46 |
| Silicone anti-foam agent | 0.01 | 0.004 |

A typical fuel composition containing an amide of this invention consists of gasoline containing the product of Example 6 in the amount of 83.2 parts per million parts of gasoline.

What is claimed is:

1. A composition comprising amides of substituted salicyclic acids in which at least one substituent in said acid is a hydrocarbon-based radical containing at least about 10 carbon atoms.

2. A composition according to claim 1 wherein the hydrocarbon-based radical is a substantially saturated aliphatic hydrocarbon radical containing about 10–225 carbon atoms.

3. A composition according to claim 2 wherein the aliphatic hydrocarbon radical is derived from propylene, 1-butene or isobutene and has a molecular weight of about 150–1750.

4. A composition according to claim 3 wherein the amide is derived from an alkylene polyamine or hydroxyalkyl-substituted alkylene polyamine.

5. A composition according to claim 4 wherein the alkylene polyamine is an ethylene polyamine.

6. A product comprising an amide according to claim 1 post-treated with an aldehyde and an amine containing at least one hydrogen atom bonded directly to nitrogen.

7. A composition according to claim 7 wherein the aldehyde is formaldehyde and the amine is an alkylene polyamine.

8. A composition according to claim 7 wherein the alkylene polyamine is an ethylene polyamine.

9. An additive concentrate comprising a substantially inert organic liquid diluent and about 20–90% by weight of a composition according to claim 1.

10. An additive concentrate comprising a substantially inert organic liquid diluent and about 20–90% by weight of a composition according to claim 2.

11. An additive concentrate comprising a substantially inert organic liquid diluent and about 20–90% by weight of a composition according to claim 4.

12. An additive concentrate comprising a substantially inert organic liquid diluent and about 20–90% by weight of a composition according to claim 5.

13. An additive concentrate comprising a substantially inert organic liquid diluent and about 20–90% by weight of a composition according to claim 6.

14. A lubricant composition comprising a lubricating oil and about 0.05%–30.0% by weight of the lubricant composition of a composition according to claim 1.

15. A lubricant composition comprising a lubricating oil and about 0.05% -30.0% by weight of the lubricant composition of a composition according to claim 2.

16. A lubricant composition comprising a lubricating oil and about 0.05%–20.0% by weight of the lubricant composition of a composition according to claim 3.

17. A lubricant composition comprising a lubricating oil and about 0.05–20.0% by weight of the lubricant composition of a composition according to claim 4.

18. A lubricant composition comprising a lubricating oil and about 0.5%–10.0% by weight of the lubricant composition of a composition according to claim 5.

19. A lubricant composition comprising a lubricating oil and about 0.05%–30.0% by weight of the lubricant composition of a composition according to claim 6.

* * * * *

UNITED STATES PATENT AND TRADEMARK OFFICE

CERTIFICATE OF CORRECTION

PATENT NO. : 4,090,971

DATED : May 23, 1978

INVENTOR(S) : Donald Irvin Hoke

It is certified that error appears in the above-identified patent and that said Letters Patent are hereby corrected as shown below:

At Column 15, line 50, i.e., claim 1, line 2, "salicyclic" should read --salicylic--.

At Column 16, line 16, i.e., claim 7, line 1, "7" should read --6--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*